United States Patent [19]

Roldan

[11] Patent Number: 4,591,230

[45] Date of Patent: May 27, 1986

[54] ELECTRICAL CONNECTOR RECEPTACLE

[76] Inventor: Frank Roldan, 937 Paularino Ave., Costa Mesa, Calif. 92626

[21] Appl. No.: 626,148

[22] Filed: Jun. 29, 1984

[51] Int. Cl.[4] ..... H01R 13/115

[52] U.S. Cl. ..... 339/258 R

[58] Field of Search ..... 339/256 R, 258 R, 258 F, 339/258 P

[56] References Cited

U.S. PATENT DOCUMENTS

| | | | |
|---|---|---|---|
| 2,779,011 | 1/1957 | Deakin | 339/258 R |
| 3,865,462 | 2/1975 | Cobaugh et al. | 339/258 R |
| 4,140,361 | 2/1979 | Sochor | 339/176 M |
| 4,175,821 | 11/1979 | Hunter | 339/258 R |

FOREIGN PATENT DOCUMENTS

| | | | |
|---|---|---|---|
| 1129580 | 5/1962 | Fed. Rep. of Germany | 339/258 R |
| 2305040 | 10/1976 | France | 339/258 R |

*Primary Examiner*—Neil Abrams

[57] ABSTRACT

Electrical receptacle contact members are provided from a stamped and coined sheet of metal. Each of the contact members include a pair of legs with offset equal dimensional contact shoes at one end extending towards each other. The staffs of the legs have an elongated rectangular configuration and are bent from an initial parallel position out of a centerplane and into a position to partially overlap each other.

17 Claims, 7 Drawing Figures

ELECTRICAL CONNECTOR RECEPTACLE

FIELD OF THE INVENTION

The present invention relates to a receptacle contact for use in the fabrication of a connector employing a plurality of such receptacle contacts arranged to receive a plurality of rows of male contact members, and more particularly to a relatively inexpensive contact of an improved design.

BACKGROUND AND SUMMARY OF THE INVENTION

This invention relates to a novel receptacle contact. More particularly, the invention concerns a receptacle contact which is formed with less wasted material than prior art receptacle contacts of the same size, and/or which provides a contact with a smaller total width. This enables better compacting of a plurality of such connectors, while at the same time providing for the male contact member to be inserted into an opening in the contact housing which has a centerline axis generally the same as the centerline axis of the receptacle contact.

In the past it has been common in the art to fabricate receptacle contacts by stamping a metal blank and coining the material stamped from the blank material into a desired shape, which may include rolling, bending or twisting certain portions of the material stamped from the blank in order to form the desired receptacle contact. An example of one such prior art connector is generally illustrated in FIGS. *6a* and *6b*. In this construction the contact is stamped out of a metal blank in the form of two legs each connected to the upper body of the contact by a narrowed portion, with connector shoes formed at the terminal ends of the legs to have convex mating surfaces, and with the legs being generally of the same length extending from the body of the contact. The narrowed portions are bent over towards each other and also out of the central plane of the upper body to place the legs in alignment with each other, forming the receptacle opening of the receptacle contact between the convex surfaces. It will be seen that the blank used to stamp out the contact shown in FIG. *6a* must have a width of approximately W shown in FIG. *6a* in order to stamp out both of the widened portions of the legs in a single stamping.

It has also been known in the prior art to form receptacle contacts with one leg shorter than the other and having convex mating surfaces spaced apart in the mating direction within the connector. Such an apparatus is shown, for example, in the patent to Sochor, U.S. Pat. No. 4,140,361. It will be noted, that the prior art contact may be stamped from a piece of material significantly narrower than that which is required to fabricate the contact discussed above. However, the mating direction of the male contact member is only aligned with one leg of the contact and is further aligned only with a laterally extending shoe portion of the other leg. This can create certain problems, for example, the mating direction is off center from the centerline of the body portion of the contact, i.e., is aligned with the centerline of one leg formed from the metal extending from the body portion of the contact, but is well off of the centerline of the other longer leg. Moreover, with the centerline of the contact aligned with the centerline of one leg, the receptacle opening for the receptacle contact must be spaced apart from an adjacent contact by an amount sufficient to account for the width of the other leg which is not aligned with the male member of the contact being inserted into the receptacle member. Thus, the distance between contacts on a connector housing having a plurality of rows of contacts must be increased to account for this off center entrance of the male contact member. Further, the front portion of the longer contact leg bears the brunt of the initial insertion of the male contact member, which can tend to weaken the contact by bending the shoe member or even breaking the shoe member due to the forces exerted on the shoe member as the male contact member is inserted. Over a large number of such insertions, as the entire connector containing multiple receptacles is mated and unmated with a connector containing the male contact members, a weakening of the laterally extending shoe portion can occur.

While such arrangements in the prior art have exhibited a degree of utility in the construction of a plurality of receptacle contacts to receive a plurality of male contact members, room for significant improvement remains. The problems enumerated in the foregoing are not intended to be exhaustive, but, rather, are among many which tend to impair the effectiveness of previously-known receptacle contacts. Other noteworthy problems may also exist; however, those presented above should be sufficient to illustrate that prior receptacle contacts have not been altogether satisfactory.

SUMMARY OF THE INVENTION

It is therefore a general object of the present invention to provide a novel receptacle contact which minimizes or reduces the problems of the type previously noted.

It is a more particular object of the present invention to provide a receptacle contact which can be stamped from a width of metal approximately equal to that shown in the Sochor patent for generally the same width of the receptacle contact legs, however, having receptacle contacts which are aligned with the centerline of the male contact member being inserted into the connector at least in the initial mating region. Also, to the extent that they are formed having shoes similar to that shown in the patent to Sochor, the insertion force is borne by both the leg and the shoe on each leg of the receptacle contact.

Another feature of the present invention relates to shaping the contact legs so that a bending arm is formed of approximately the same length for each contact leg which bending arm deflects as the male contact member is inserted into the receptacle contact.

Yet another feature of the present invention relates to forming the legs of the contact member by punching out a section of elongated material extending between the legs from the body of the contact member to the end of a first leg, or the shoe of a first leg, and also removing a piece of metal at the end of the first leg and adjacent to the second leg, or the shoe on a second leg, with the legs then being bent out of the central plane of the body portion of the receptacle contact, and further bent to partially overlap each other with a portion of each overlapping the centerline of the male contact member being inserted into the receptacle member. The male contact member then has a centerline axis parallel to the insertion direction, and with at least a portion of each leg of the receptacle member in the region of initial insertion of the male contact member having the centerline generally aligned with the centerline of the male contact member.

Still another feature of the present invention involves the forming of the ends of the legs, or if the legs have additional laterally extending shoes, the shoes as well, into convex mating surfaces.

Examples of the more important features of the invention have thus been summarized rather broadly in order that the detailed description thereof that follows may be understood, and in order that the contribution to the art may be better appreciated. There are, of course, additional features of the invention that will be described hereinafter and which will also form the subject of the appended claims. These other features and advantages of the present invention will become apparent with reference to the following detailed description of a preferred embodiment thereof in connection with the accompanying drawings wherein like reference numerals have been applied to like elements.

DESCRIPTION OF A PREFERRED EMBODIMENT OF THE INVENTION

Figure 1:
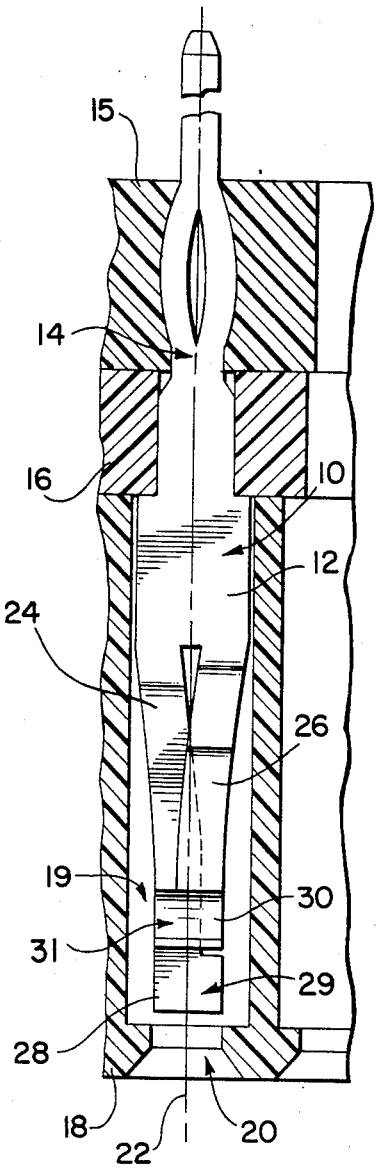
FIG. 1 depicts a plan view of a receptacle contact constructed according to the present invention.

Turning now to FIG. 1, a plan view of the receptacle contact of the present invention generally designed as 10 can be seen. The receptacle contact 10 has a body portion 12 with a body extension contact portion 14 extending through a base 16 made of, for example, plastic material, into which the body extension contact portion 14 is inserted. The upper portion of the body extension contact portion 14 is connected to electrical circuitry (not shown) in a printed circuit board 15 by any of a number of means well known in the art. A cover or housing portion 18 is connected to the base 16 by any of a number of means well known in the art and contains an internal cavity 19 which surrounds the receptacle member 10, and provides an opening 20 into which a male contact member (FIG. 2) is inserted. The receptacle member contains a first leg 24 which has at the terminal end a contact surface or shoe portion 28 formed from the metal at the terminal end of the leg and which may have a laterally extending shoe portion 29. A second leg 26 is also formed with a contact surface shoe portion 30 at its terminal end which may have a laterally extending shoe portion 31. The legs 24, 26 are bent to ovelap each other and the centerline of the male contact member which can be inserted into the receptacle member 10. When found, the respective contact surfaces 28 and 29 are aligned on a longitudinal axis although relatively displaced on the same axis. It will be seen, that at least at the initial mating region the centerline of each of the legs 24 and 26 is generally aligned with the centerline 22 of the body portion which coincides with the centerline 50 of the male contact member 48 (FIG. 2).

Figure 2:
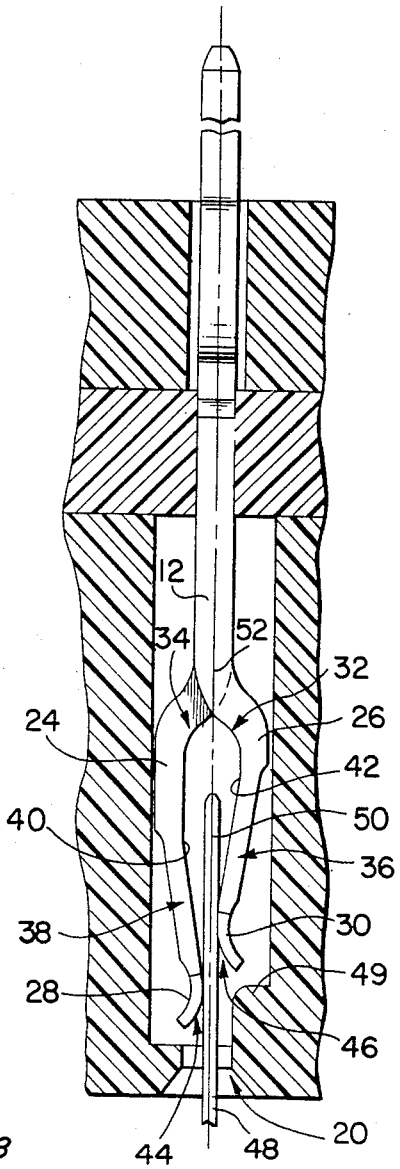
FIG. 2 discloses the side elevational view of FIG. 1 rotated 90°.

The width of the body member in the embodiment shown in FIGS. 1 and 2 in, e.g., 0.075 inches and the width of each leg 24, 26 is, e.g., 0.030 inches, with the laterally extending shoe portions 29, 31 combine with the leg 24, 26 widths to have a total width of 0.045. The difference between 0.045 and 0.030, i.e., 0.015 is the width of the amount of material stamped out of the metal extending from the body 12 to initially form the separate legs 24, 26.

FIG. 2 shows a side elevational view of the apparatus of FIG. 1 rotated 90°. It will be seen that the first leg 24 is bent out of the central plane 52 of the body portion 12, from which the metal forming the leg 24 has been punched to separate the leg 24 from the leg 26. The bend is coined to form a rounded portion 34 having an inside radius of curvature of approximately 0.025 inches, with the thickness of the body 12 being of also approximately 0.025 inches. The base of the contact 10 or point of bifurcation of the legs 24 and 26 has been specifically designed to have extra strength for supporting an insertion blade or tool (not shown) during the insertion of contact pins into a mother board or connector housing.

The leg portion 24 then extends from the curved portion 34 to a region where the leg is coined to a flatter cross-section of approximately 0.012 inches. The flattened portion 38 is bent toward an extension of the central plane 52, forming a breakpoint 40 on the side of the leg 24 facing the extension of the central plane 52. The lower end of the leg is coined to form a shoe 28 having a convex mating surface 44 facing the extension of the central plane 52. The shoe 28 is formed having a radius of curvature of the convex surface 44 of approximately 0.035 inches.

The other leg 26 is similarly formed with a rolled flattened portion 36 extending to the terminal end of the leg 26, at which is formed the shoe 30 having a convex mating surface 46, also having a radius of curvature of approximately 0.035 inches. The leg 26 has a curved portion 32 having a radius of curvature of approximately 0.025 inches and has a breakpoint 42 from which the flattened portion 36 is bent towards the extension of the central plane 52. The distance, in a line parallel to the extension of the center plane 52, between the breakpoint 40 and the center of the radius of curvature of the shoe 28 is equal to the distance, also in a line parallel to the extension of the center plane 52, between the breakpoint 42 and the center of the radius of curvature of the convex surface 46, with each being of a length of approximately 0.130 inches.

It will be seen in the illustration in FIG. 2 that the centerline 50 of the male contact member 48 corresponds to an insertion plane through the centerline 22 of the opening 20, and also is aligned with the central plane 52 of the body portion 12. The male contact member 48 has a tapered initial contact surface 49 which initially contacts the convex surface 44 on the leg 24 and then contacts the convex surface 46 on the leg 26.

The insulative housing entrance 20 has a step portion 49 to provide protection for the lower beam or leg 26 of the contact from damage by the insertion of a male contact.

Figure 3:
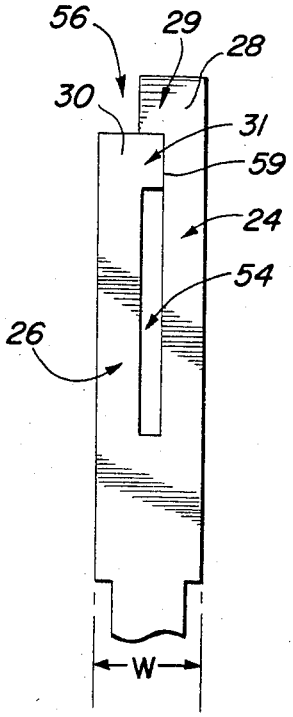
FIG. 3 shows a plan view of the material stamped from the blank in order to initially form the contact according to the present invention.

Turning now to FIG. 3, there is shown a manner of punching the receptacle contact 10 of the present invention from a metal blank. The blank is punched to form a receptacle contact 10 having a width W which, in the preferred embodiment, is approximately 0.075 inches. In the same or in a subsequent punching operation, an elongated portion 54 is cut out between the legs 24 and 26. An end portion 56 is removed adjacent the end of leg 26 and the laterally extending shoe 28 on the leg 24. A cut is made along a line 59 separating the laterally extending shoe portion 31 on the leg 26 from the leg 24 and the laterally extending shoe portion 29 on the leg 24. This results in the elongated portion 54 having a width of approximately 0.015 inches, with each leg having a width of approximately 0.030 inches and the end portion 56 having a width of approximately 0.030 inches with a length of the same value as the laterally extending shoe portion 29 on the leg 24. The legs 24 and 26 with the attached shoes 28, 30 are then coined as described above and bent over to overlap each other as described above. It will be understood that the laterally extending shoe portions 29, 31 forming an L shape at the end of each of the legs 24 and 26 could be eliminated. In such an embodiment the elongated portion 54 would extend the full length of the leg 24. The legs 24 and 26 in such an embodiment would then be bent over such that the legs 24 and 26 are generally fully overlapped at least in the mating region of each, with the centerline of each in the mating region aligned with the centerline of the male contact member.

Figure 6A:
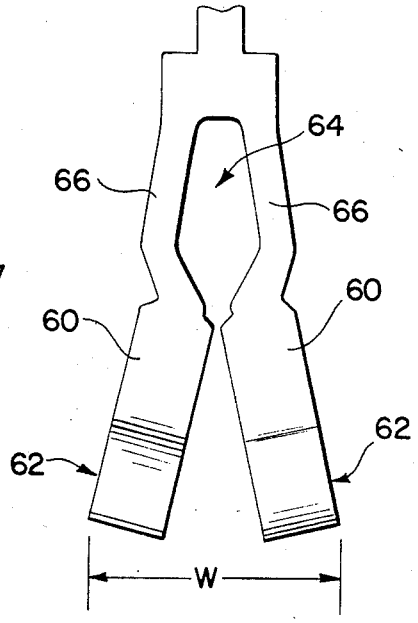
FIG. 6a PRIOR ART
Figure 6B:
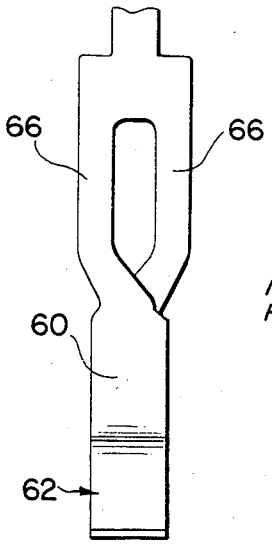
FIG. 6b PRIOR ART

Contrasting this construction with the prior art, the apparatus shown in FIGS. 6*a* and 6*b* can be seen to require a width $W_1$ almost three times the width of each leg 60 containing a shoe portion 62. Moreover, there is a greater degree of wasted metal in cutting out the section 64 between the narrowed upper portions 66, above legs 60 and around those narrowed portions 66 to form the connector. The prior art connector is shown in FIG. 6*b* with the legs 60 bent over each other to fully overlap each other with the convex mating surfaces abutting each other at the mating end of the receptacle contact member shown in FIG. 6*b*. It will also be seen in the prior art design that, for a given width of the legs 60, the narrowed upper portion 66, being significantly narrower, provides less strength in the upper portion 66 of the connector legs 60.

Figure 4:
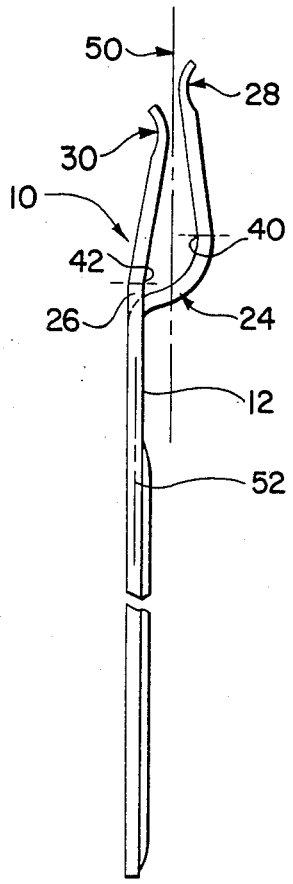
FIG. 4 depicts a side elevational view of an alternative embodiment of the present invention.

FIG. 4 shows an alternative embodiment of the present invention at which the longer leg 24 is coined to have a radius of curvature of approximately 0.043 inches with a breakpoint 40. The distance between the breakpoint 40 and the center of the radius of curvature of the coined shoe 28 at the terminal end of the leg 24 equals approximately 0.130 inches. The shorter leg 26 is bent from the extension of the center plane 52 of the body member 12 of the receptacle contact 10 in the same direction as the longer leg 24 is bent, with a breakpoint 42 being formed at the point of the bend of the leg 26. The distance between the radius of curvature of the shoe 30 on the leg 26 equals approximately 0.130 inches. In this embodiment, the mating plane 50 is not aligned with the central plane 52 of the receptacle connector 10, but is parallel thereto.

This embodiment of FIG. 4 may be more suitable to types of connectors in which the receptacle contacts 10 are inserted with an insertion tool which applies pressure to each receptacle contact to force it into an opening in the plastic material of an insulator. In the embodiments of FIGS. 1 and 2 the insertion tool will be applying force along a line corresponding to the central plane 52 of the receptacle contact 10 shown in FIGS. 1 and 2.

Figure 5:
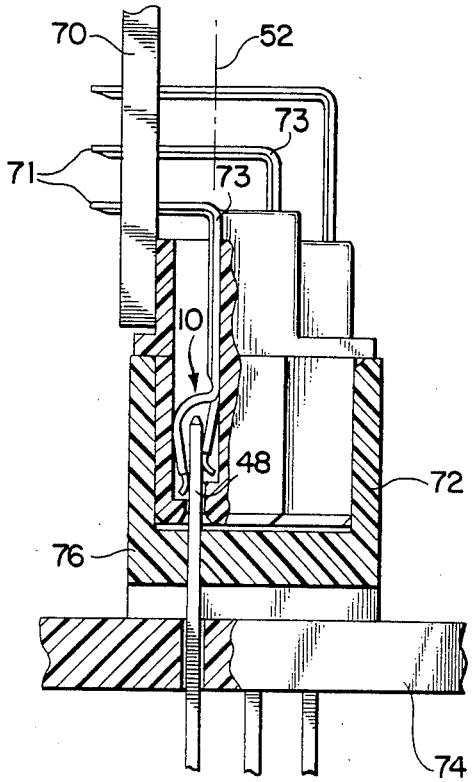
FIG. 5 shows a side elevational view of a connector housing with the contact of FIG. 4 in place; and FIGS. *6a* and *6b* show a plan view of a blank stamped to form a prior art receptacle contact, with FIG. *6b* showing the final form of the contact after the legs are bent into the final position.

An embodiment which may use the receptacle contacts 10 of FIG. 4 is shown in FIG. 5. There a daughter card 70 is shown containing multiple rows of contacts 71 and formed with the female contacts 10 in a housing 72 in which the contacts extensions 73 are bent to extend towards the opening in the female contacts portion of the housing 72. The male contacts 48 are provided on a mother board 74 having a male connector housing 76 which extends over a portion of the daughter board 70 and aligns the respective male contact members 48 with the respective receptacle contacts 10 as shown in FIG. 5. The male contact members 48 may be, e.g., an Eye of the Tiger compliant section contact offered for sale by Roldan Engineering, Inc. of Costa Mesa, Calif.

As seen in FIG. 5, the daughter card 70 receives the contact pins at a 90° angle to the central plane 52. By providing a relatively flat side surface on the shorter contact leg, additional support is provided during insertion of contact 71 tails into the daughter card 70.

SUMMARY OF THE SCOPE AND ADVANTAGES OF THE INVENTION

It will be appreciated that in constructing a receptacle contact member according to the present invention, certain significant advantages are provided.

In particular, with the contact legs being of different lengths, the male contact member contacts one leg before the other, as is known in the art, but in the present invention, the legs are generally aligned with the centerline of the male contact member, and also of the body member, at least in the mating region, where such contact with the male contact member initially occurs. Further, the legs are arranged to be better able to withstand numerous connect and disconnect operations than prior art receptacle contact legs of generally the same leg width, and can be cut from a smaller width of metal than similar prior art receptacle contacts in which the legs are overlapped to have their centerline aligned with that of the male contact member. Also, the formation of a breakpoint in the extension of the legs, about which the legs bend when the male contact member is inserted, with the distance from the breakpoint to the center of curvature of the shoe member formed on each leg, adds durability and strength to the contact.

The foregoing description of the invention has been directed to a particular preferred embodiment in accordance with the requirements of the Patent Statutes and for purposes of explanation and illustration. It will be apparent to those skilled in the art that many modifications and changes could be made without departing from the scope and spirit of the invention. These modifications will be apparent to those skilled in the art and it is Applicants' intention in the following claims to cover all such equivalent modifications and variations as fall within the true spirit and scope of the invention.

What is claimed is:

1. A receptacle contact for receiving a male contact member, with the male contact member having a longitudinal centerline axis lying in a mating plane, comprising:

a generally flat metal body having a center plane parallel to the mating plane;

a first leg and a second leg having respective shoes stamp formed from the metal body and extending from a lower section of the body by removing a longitudinal elongated section of the metal intermediate the first and second legs, the width of material removed by stamping of the longitudinal elongated section being equal to the offset width of the respective shoes from their associated leg to provide a pair of parallel elongated rectangular legs, and removing a portion of the metal bordering adjacent both the side of the first leg and the end of the second leg to provide a pair of offset shoes having a wider dimension than the width of each leg, both shoes being offset to the adjacent inside surface of each leg and the legs being cantilevered from the lower body section thereby forming each leg into an L-shape, with the first leg shoe extending further from the lower body section and overlapping the second leg section along the longitudinal centerline axis;

the first leg and second leg being bent from their parallel position to deformably move an inner edge of one leg transversely past an inner edge of the other leg so that the legs are out of the center plane; and the first leg and the second leg being further bent to partially overlap each other and with the centerline of each generally aligned with the centerline of a received male contact member at least along a mating region of each leg, each of the first and second legs being further bent towards the mating plane and forming a breakpoint on each leg at the location of the further bend, with the distance between the breakpoint and the shoe member on each leg being approximately equal.

2. The apparatus of claim 1, wherein the mating plane and the center plane are co-planar.

3. The apparatus of claim 1 further comprising:

a convex mating surface formed at the terminal end of each of the first and second legs.

4. The apparatus of claim 2 further comprising:

each of the first and second legs being bent to lie out of the center plane, one on each side of the center plane.

5. The apparatus of claim 1, further comprising:

each of the first and second legs being bent to reside on the same side of the center plane.

6. The apparatus of claim 4 further comprising:

a convex mating surface formed at the terminal end of each of the first and second legs.

7. The apparatus of claim 5 further comprising:

a convex mating surface formed at the terminal end of each of the first and second legs.

8. The apparatus of claim 3 further comprising:

each of the first and second legs being bent to lie out of an extension of the center plane, one on each side of the center plane.

9. A receptacle contact stamp formed from a metal blank for receiving a male contact member, with the male contact member having a longitudinal centerline axis lying in a mating plane, comprising:

a generally flat metal body having a center plane parallel to the mating plane;

a first leg and a second leg, each having a shoe of equal dimension with a wider dimension than the width of each leg and offset from each leg to provide an L-shape at the terminal end of each leg, each leg being formed in the metal extending from the body by removing an elongated section of the metal extending from the body, intermediate the first and second legs, such removal causing the second leg to become L-shaped with said shoe of the second leg extending towards the longitudinal axis of the first leg and being approximately located adjacent the corner formed by the L-shape of the first leg, and by removing a portion of the metal bordering adjacent both the side of the shoe on the first leg and the end of the shoe on the second leg to cause the second leg to be longitudinally shorter than the first leg by at least the length of the shoe of the first leg;

the first and second legs being bent to deformably move an inner edge of the leg transversely past an inner edge of the other leg and in such a manner to lie out of an extension of the center plane; and the first leg and second leg each being bent to deformably move an inner edge of one leg transversely past an inner edge of the other leg so that the legs partially overlap each other and the longitudinal centerline of any mating male contact member, at least in a mating region of each leg.

10. The apparatus of claim 9 further comprising:

each of the first and second legs being bent to lie out of an extension of the center plane, one on each side of the center plane.

11. The apparatus of claim 9, further comprising:

each of the first and second legs being bent to lie out of an extension of the center plane, each on the same side of the extension of the center plane.

12. The apparatus of claim 10 further comprising:

each shoe being formed to have a convex mating surface.

13. The apparatus of claim 11 further comprising:

each shoe being formed to have a convex mating surface.

14. A receptacle contact stamp formed from a metal blank for receiving a male contact member, having a longitudinal centerline axis lying in a mating plane, comprising:

a generally flat metal body having a center plane aligned with the mating plane;

a first leg and a second leg, each having a shoe with a wider dimension than the width of each leg, stamp formed from the metal body to form each leg into an L-shape at the terminal end of each leg, and each leg being formed in the metal extending from a lower section of the body by removing an elongated section of the metal intermediate the first and second legs, such removal causing the second leg to become L-shaped with said shoe of the second leg extending towards the longitudinal axis of the first leg and being approximately located adjacent the corner formed by the L-shape of the first leg, and by removing a portion of the metal bordering adjacent both the side of the shoe on the first leg and the end of the second leg to cause the second leg to be longitudinal shorter than the first leg by at least the length of the shoe of the first leg;

the first and second leg each being bent out of an extension of the center plane; and the first and second leg each being further bent to deformably move an inner edge of one leg transversely past an inner edge of the other leg so that the legs partially overlap each other and with a portion of each of the first and second legs overlapping the longitudinal centerline axis of the received male contact member and positioning the offset shoes to extend towards the longitudinal centerline axis.

15. The apparatus of claim 14 further comprising:

each shoe being formed to have a convex mating surface.

16. The apparatus of claim 15 further comprising:

each of the first and second legs being bent to reside on the same side of the center plane.

17. A receptacle contact stamp formed from a metal blank for receiving a male contact member, having a longitudinal centerline axis lying in a mating plane, comprising:

a generally flat metal body having a center plane aligned with the mating plane;

a first leg and a second leg, each having a shoe with a wider dimension than the width of each leg forming each leg into an L-shape at the terminal end of each leg, and each leg being formed in the metal extending from the body by removing an elongated section of the metal extending from the body intermediate the first and second legs, such removal causing the second leg to become L-shaped with said shoe of the second leg extending towards the longitudinal axis of the first leg and being approximately located adjacent the corner formed by the L-shape of the first leg, and by removing a portion of the metal adjacent both the side of the shoe on the first leg and the end of the shoe on the second leg to cause the second leg to be longitudinally shorter than the first leg by at least the length of the shoe of the first leg;

the first and second leg each being bent out of an extension of the center plane; and the first and second leg each being further bent to deformably move an inner edge of one leg transversely past an inner edge of the other leg so that the legs partially overlap each other and with a portion of each of the first and second legs overlapping the longitudinal centerline axis of the male contact member, each of the shoes being formed to have a convex mating surface and to extend from their respective legs towards the longitudinal centerline axis.

* * * * *